US005775380A

United States Patent [19]

Roelstraete et al.

[11] Patent Number: 5,775,380

[45] Date of Patent: Jul. 7, 1998

[54] WARP BEAM REPLACEMENT AND THREADING APPARATUS

[75] Inventors: Kristof Roelstraete, Zwevegem; Henry Shaw, Woesten-Vleteren, both of Belgium

[73] Assignee: Santrade Ltd., Lucerne, Switzerland

[21] Appl. No.: 687,337

[22] PCT Filed: Jan. 27, 1995

[86] PCT No.: PCT/EP95/00289

§ 371 Date: Sep. 11, 1996

§ 102(e) Date: Sep. 11, 1996

[87] PCT Pub. No.: WO95/21282

PCT Pub. Date: Aug. 10, 1995

[30] Foreign Application Priority Data

Feb. 2, 1994 [BE] Belgium ..... 9400121

[51] Int. Cl.[6] ..... D03J 1/00; D03J 1/02

[52] U.S. Cl. ..... 139/1 R; 28/201; 28/208; 28/209; 156/158

[58] Field of Search ..... 139/1 R, 35; 28/209, 28/208, 211, 201, 203.1; 156/158

[56] References Cited

U.S. PATENT DOCUMENTS

| | | | |
|---|---|---|---|
| 2,585,708 | 2/1952 | Welch | 28/209 |
| 4,768,564 | 9/1988 | Yamada . | |
| 4,934,413 | 6/1990 | Yao | 139/1 R |
| 5,316,048 | 5/1994 | Gruwez | 139/1 R |
| 5,371,930 | 12/1994 | Lindenmueller et al. | 139/1 R |
| 5,430,916 | 7/1995 | Plaschy et al. | 139/1 R |
| 5,514,234 | 5/1996 | Plaschy et al. | 28/201 |

FOREIGN PATENT DOCUMENTS

| | | | |
|---|---|---|---|
| 0 557 745 | 9/1993 | European Pat. Off. . | |
| 0 592 807 | 9/1993 | European Pat. Off. | 139/1 R |
| 2-269844 | 11/1990 | Japan | 139/1 R |
| 669 303 | 3/1989 | Switzerland . | |
| 93/19233 | 9/1993 | WIPO . | |

*Primary Examiner*—Andy Falik

*Attorney, Agent, or Firm*—Burns, Doane, Swecker & Swecker, L.L.P.

[57] ABSTRACT

After a warp beam on a loom is used up, its old warp threads are separated from a material being woven on the loom. The used-up beam, together with its residual old warp threads, is then mounted on a transport device and moved away from the loom. A winding element rotatably mounted on a maintenance device is positioned adjacent the transport device. Leading ends of the old threads are affixed to the winding element and separated from the used-up beam, whereafter the used-up beam is replaced by a new beam. Leading ends of new threads on the new beam are attached to trailing ends of respective ones of the old threads, whereafter the winding element is rotated to wind-up the old threads and parts of the new threads, while pulling the new threads through a loom device (such as a warp stop motion device, and/or a shedding device, and/or a weaving reed) carried on the transport device. Then, the winding element is rolled along a guide surface to a removal device. A bonding mechanism carried by the removal device bonds a plastic foil to the new threads, whereafter the new threads are separated from the winding element, and the removal device is removed, along with the winding device.

21 Claims, 16 Drawing Sheets

WARP BEAM REPLACEMENT AND THREADING APPARATUS

BACKGROUND OF THE INVENTION

The subject of the invention is a method for passing new warp threads through a warp stop motion device and/or a shedding device and/or a weaving reed of a power weaving loom whereby old warp threads are attached to the new warp threads of a new warp beam and are taken up by means of a winding device in which the attached warp threads are wound onto the winding element until the area in which the old warp threads and the new warp threads are attached is located in the area of the winding element, and also an apparatus for carrying out the method.

It is customary to attach the new warp threads of a new warp beam to the old warp threads which run through drop wires of a warp stop motion device and/or the heddle of shafts and/or the weaving reed. For example, the threads can be attached by means of knots or splicing. U.S. Pat. No. 4,768,564 discloses a method in which the attached warp threads are pulled through the warp stop motion device and/or the shafts and/or the weaving reed by means of a fabric take-up device until the attachment points have passed the weaving reed. At this point the weaving process can continue. Such a method is disadvantageous in that the power weaving loom is idle and does not weave while the threads are attached and pulled through. In addition, the new warp threads are attached and pulled through directly on the power weaving loom under unfavorable working conditions such as poor lighting, climate and ambient noise.

It is also customary (EP 0 557 745 A1) for a part of a power weaving loom to be removed, which part contains the warp beam, the warp stop motion device and/or the shedding devices. When a warp beam in such a machine is used up and must be replaced with a new warp beam, the part can be removed from the power weaving loom and can be moved to a different location. Here the warp threads of the new warp beam can be tied or spliced to the warp threads of the used warp beam and drawn in under ideal conditions.

It is also customary (WO 93/19233) to bond a plastic foil to the beginnings of a new warp thread assemblage so that these warp threads can easily be introduced into the power weaving loom, especially into the fabric take-up roller of the power weaving loom.

OBJECTS AND SUMMARY OF THE INVENTION

The object of the invention is to enable the new warp threads which are pulled through a warp stop motion device and/or a shedding device and/or a weaving reed to be prepared in a manner which makes it possible to pull them further into the power weaving loom in a simple manner.

The object of the invention is attained in that the winding device, after the warp threads are taken up, is moved with the warp threads from a take-up position into a receiving position in which the warp threads are received.

By moving the winding element from a take-up position into a take-over position the new warp threads can be taken over effectively so that the subsequent processing and the further introduction of the warp thread assemblage into the power weaving loom is simplified.

In a beneficial embodiment of the invention the winding element rotates in the direction of the uncoiling process while it is moved from the winding position to the take-over position. This makes the transition easy.

In another embodiment of the invention the winding element is rolled on guide devices to the take-over device whereby the direction of rotation of the rolling motion corresponds to the direction of rotation of the uncoiling movement. This means that it is easy to operate the winding element which can also be carried out manually.

Taking the invention one step further the winding element is moved to a bonding device and the warp threads are bonded to a foil.

In a preferred method the old warp threads are separated in the area of the woven material and then the used up warp beam together with the warp stop motion device and/or the shedding device and/or the weaving reed is moved from a power weaving loom. Then, the old warp threads are taken up by a winding element, are separated from the used-up warp beam, a new warp beam is inserted and the new warp threads are attached to the old warp threads. Then, the attached warp threads are wound up by the winding element until the area of the attachment between the old warp threads and the new warp threads is located in the area of the winding element and then the winding element is moved towards a device for taking over the warp threads. This method can be carried out in an especially advantageous manner on a power weaving loom with a structure which is identical to the principle disclosed in EP 0 577 745 A1.

In another development of the invention a device for carrying out the method is used in which the winding element, while carrying along the warp threads, can be moved from its winding position into a take-over position in which the warp threads can be met by take-over devices.

BRIEF DESCRIPTION OF THE DRAWING

Other characteristics and advantages of the invention can be taken from the subsequent description of the embodiment example shown in the drawing.

DETAILED DESCRIPTION OF PREFERRED EMBODIMENTS OF THE INVENTION

Figure 1:
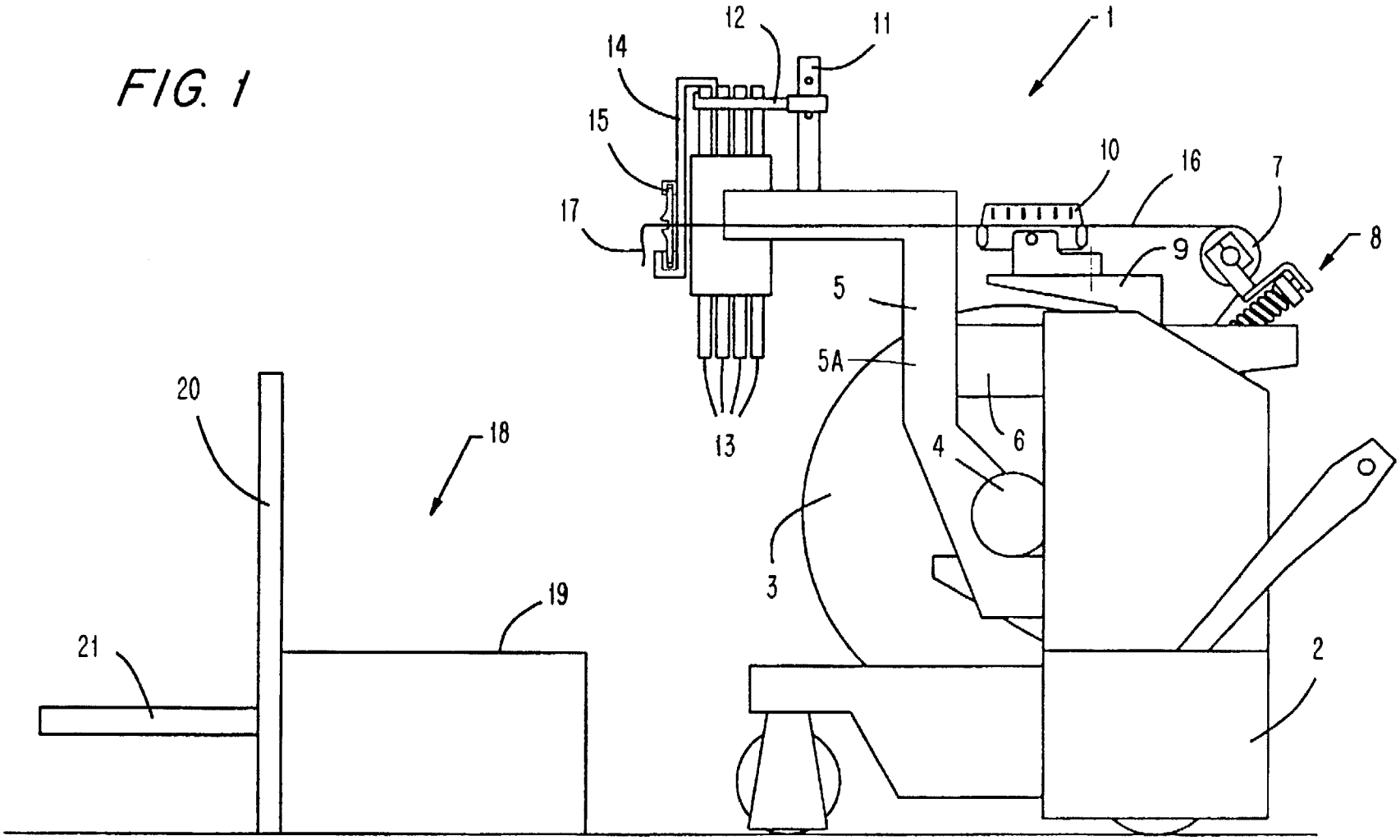
FIG. 1 shows a schematic side view of a part of a power weaving loom with a warp beam, a warp stop motion device, a shedding device and a weaving reed, which part is removed from the power weaving loom and is moved to a stand by means of a transport device.

A part (1) of a power weaving loom shown in FIG. 1 was removed from the power weaving loom, which is not shown, by means of a transport or supporting device (2). The loom part (1) is comprised of a used up warp beam (3) of which the warp beam flanges and the axle (4) are shown. The axle (4) is attached to a frame (5) of the loom part (1) which frame loom which is comprised of two lateral parts (5A) and a cross strut. Retainer arms (6) are attached to the lateral parts (5A) of the frame (5) with the arms maintaining a back rest (7) by means of a retainer device (8). In addition supports (9) are attached to the retainer arms (6) which supports warp stop motion carry a device (10). In addition, supports (11) are attached to the lateral parts of the frame (5) with the supports (11) maintaining heald shafts (13) of a shedding device by means of retainers (12). Two hooks (14) are hooked into the last heard shaft (13) in the direction of movement of the warp thread with the hooks maintaining a weaving reed (15) at both its ends. Before the loom part (1) was removed from the power weaving loom by means of the transport device (2), the power weaving loom was made idle before the warp threads (16) had become completely removed from the warp beam (3). The warp threads (16) were cut in the area of the woven material in the direction of movement of the warp threads following the weaving reed (15). It is practical for this cutting process to take place when the woven material still consists of the warp threads (16) and the woof threads so that the ends of the warp threads which are cut end in one woven strip of material (17). This means that the warp threads (16) of the used up warp beam (3) still are located in the loom part (1). They run from the used up warp beam (3) over the back rail (7) through the warp stop motion device (10) through the heald shafts (13) and through the weaving reed (15) which is followed by the strip of woven material (17).

Figure 2:
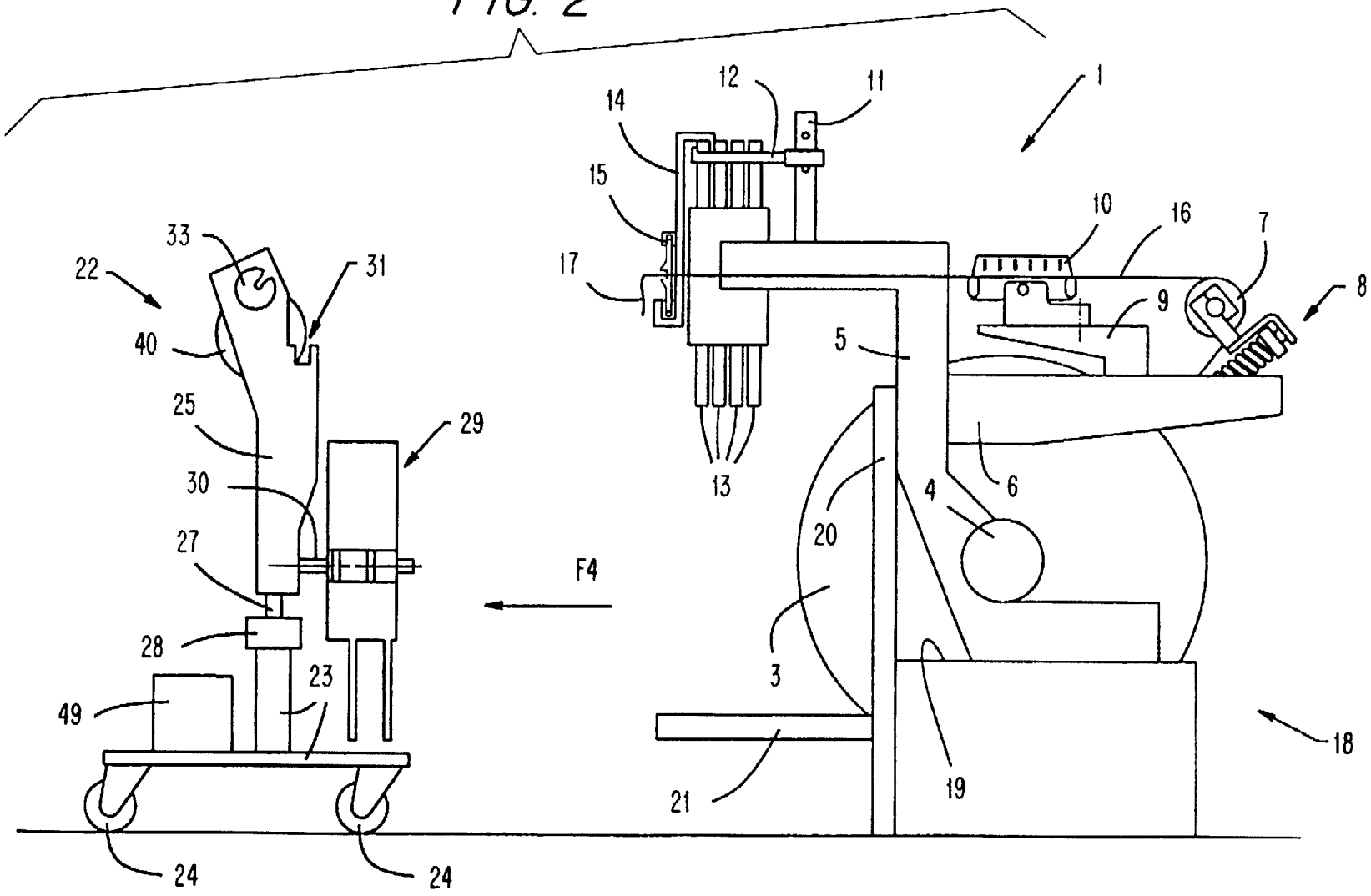
FIG. 2 shows the loom part which rests on the stand and a maintenance device which contains a winding element.

The loom part (1) is placed on a stand (18) by the transport device (2) with the stand having horizontal contact surfaces (19) and vertical support surfaces (formed by pillars (20) for supporting the frame (5) (see FIG. 2). Arms (21) extend from the pillars (20) whose significance will be explained later on. The stand (18) can be stationary as is shown in the drawings. It can also have casters so that it can be moved.

Figure 3:
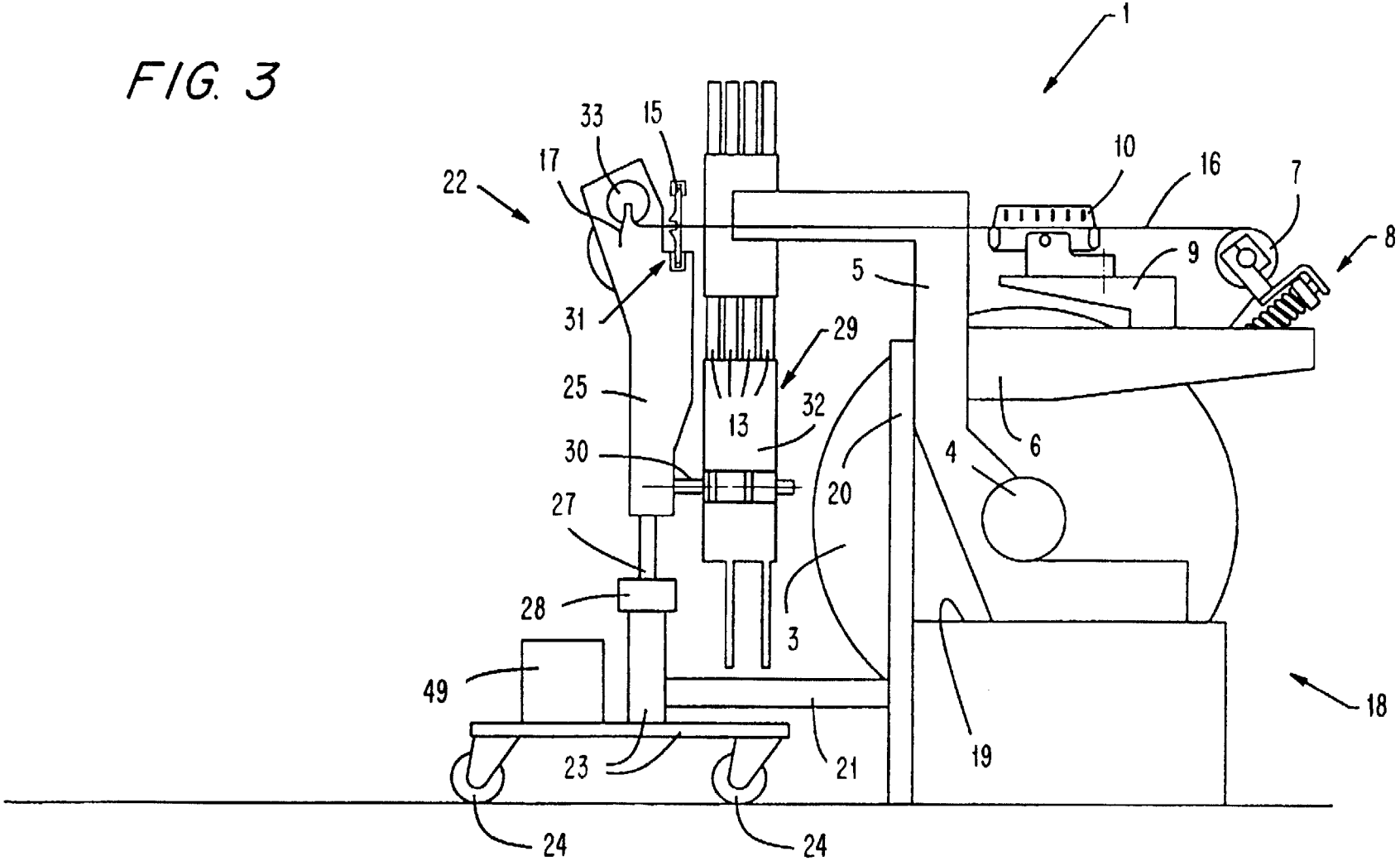
FIG. 3 shows a drawing that is similar to that in FIG. 2 in which the maintenance device is already positioned and in which the old warp threads are attached to the winding element.

As is shown in FIG. 2 and 3, a moveable maintenance device (22) is positioned with regard to the loom part (1) which is now located on the stand (18). The maintenance device (22) also is shown in more detail in FIG. 4, 5, and 6. The maintenance device (22) is comprised of an undercarriage (23) which has casters (24). The undercarriage has a frame (25) whose height can be adjusted. The frame (25) is equipped with two threaded spindles (27) with spindle nuts (28) which can rotate on the undercarriage (23). The height of the frame (25) in relation to the undercarriage (23) can be adjusted by turning the nuts (28).

The frame (25) has two support elements (29) which take up the heald shafts (13) as shown in FIG. 3. These support elements (29) have two crossed-shaped arms (32, 34, 35, 36) which are attached to the frame (25) and can rotate around a horizontal axis (30) (see FIG. 4). The arms (32) of the two support elements (29) are connected by means of a connecting rod (76) so that the support elements (29) must be rotated together. The arms (32, 34, 35, 36) have support surfaces S, S',S",S '" which have different spacings with regard to the axis of rotation (30) so that the heald shafts are supported in different height positions in accordance with the position of the support elements (29) as will be explained in more detail below. The frame (25) also has a retainer (31) for the weaving reed (15).

FIG. 3 shows that the maintenance device (22) has moved all the way up to the arms (21). In this position the maintenance device can be secured by securing devices, which are not shown, against inadvertent movements. The support elements (29) are set so that the arms (32) are located under the heald shafts (13). By rotating the spindle nuts (28) the height of the frame (25) is adjusted so that the arms (32) support the heald shafts (13). The retainers (12) and/or the supports (11) have been removed so that the heald shafts (13) are supported by the arms (32) of the support elements (29). The weaving reed (15) is removed from the hook (14) and is inserted into the retainers (31) of the frame (25). Then the hooks (14) are removed.

Figure 5:
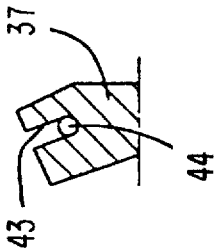
FIG. 5 shows a partial section along line 5—5 of FIG. 4.
Figure 6:
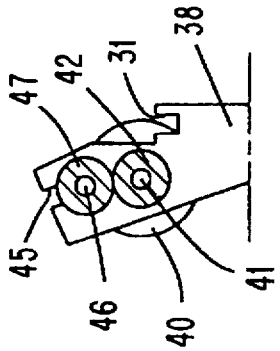
FIG. 6 shows a partial section along line 6—6 of FIG. 4.
Figure 4:
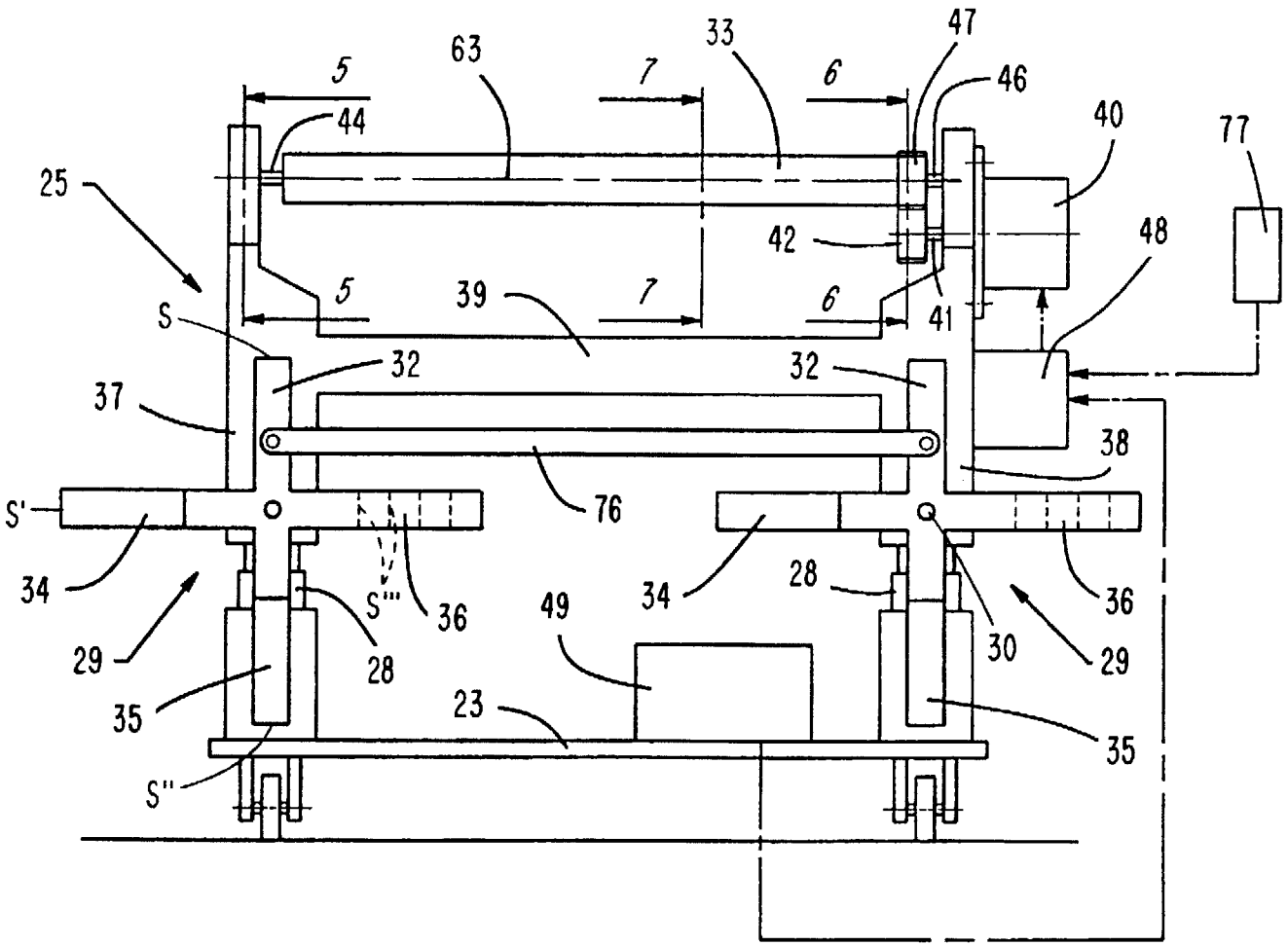
FIG. 4 shows a view in the direction of arrow F4 of FIG. 2.

The frame (25) of the maintenance device (22) also has a cylindrical winding element (33) which essentially is located at the level of the plane in which the warp threads (16) run. FIG. 4 shows that the frame (25) has two lateral parts (37, 38) which are connected by means of a cross strut (39). There is an actuation motor (40) on the lateral part (38) with the motor shaft (41) of the motor having a gearwheel (42). The gearwheel (42) interacts with a gearwheel (47) of the winding element (33) to form a releasable drive-transmitting coupling with the winding element(33). The upper end of the lateral part (37) has a slot-shaped bearing retainer (43) for an axis pin (44) of the winding element (33) as can be seen in FIG. 5. Similarly the upper end of the lateral part (38) has a slot-shaped bearing retainer (45) for a bearing neck (46) of the winding element which is located opposite the bearing neck (44). The two bearing retainers (43, 45) are open on top and are tilted away from the retainer (31) of the weaving reed (15). This means that the winding element (33) can be removed from the bearing retainers (43, 45) from the top. When it is removed the gearwheels (42, 47) are separated as well so that the actuation between the actuation motor (40) and the winding element (33) is interrupted. This actuation is reestablished or re-coupled when the winding element (33) together with its bearing necks (44, 46) is inserted again into the bearing retainers (43, 45). It will be appreciated that the bearing retainers (43, 45) and the bearing necks (44, 46) form a connector for rotatably securing the winding element (33) to the frame (25), while permitting the winding element to be removed from the frame (25).

The actuation motor (40) is actuated at a certain speed by means of a control unit (48). The control unit (48), which is attached to the lateral part (38), is activated by means of remote control (77). The remote control (77), which has operating buttons for starting and stopping the actuation motor (40) as well as for controlling the speed of the actuation motor (40), is connected to the control unit (48) by means of a cable. It can also work wireless, for example, by means of infrared beams or radio contact. The control unit (48) can also be equipped with a voice recognition system so that it is possible to issue operating commands. There are batteries (49) on the undercarriage (23) of the maintenance device (22) which are connected to the control unit (48) and which provide the actuation energy for the actuation motor (40). This means that the maintenance device (22) is an independent unit which can be moved.

Figure 9:
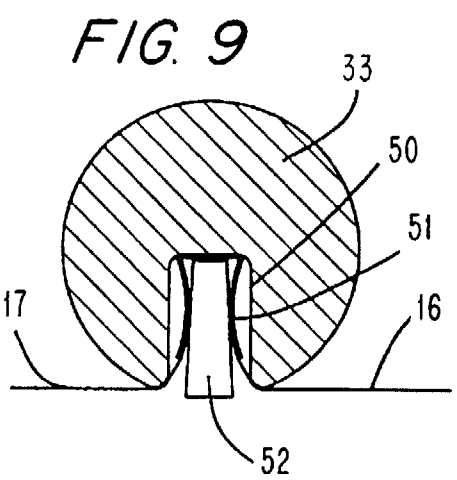
FIG. 7 through 9 show sections along line 7—7 of FIG. 4 through the winding element while the old warp threads are being attached to this winding element.
Figure 8:
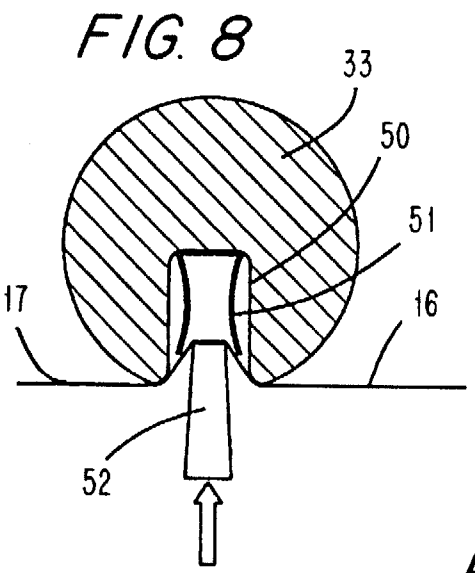
Figure 7:
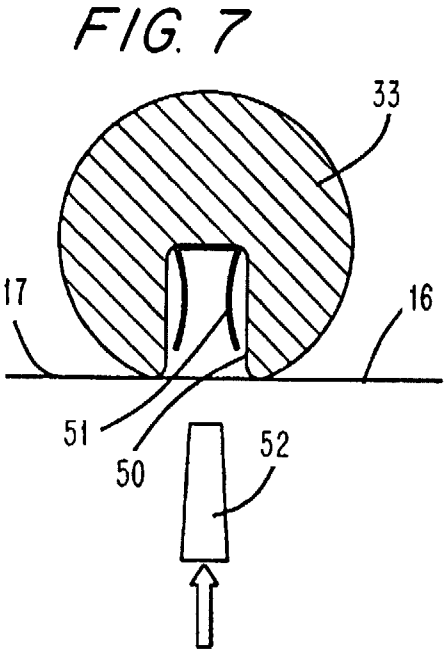

FIG. 7 through 9 show that the winding element (33) for the most part is comprised of a cylindrical body which has a longitudinal slot (50). There is an elastic cramping device (51) in the longitudinal slot (50) which has a wedge (52) made of wood or a similar material. The wedge (52) pushes the warp threads (16) and/or the woven material strips (17) into the cramping device (51) so that they are connected to the winding element (33).

Figure 10:
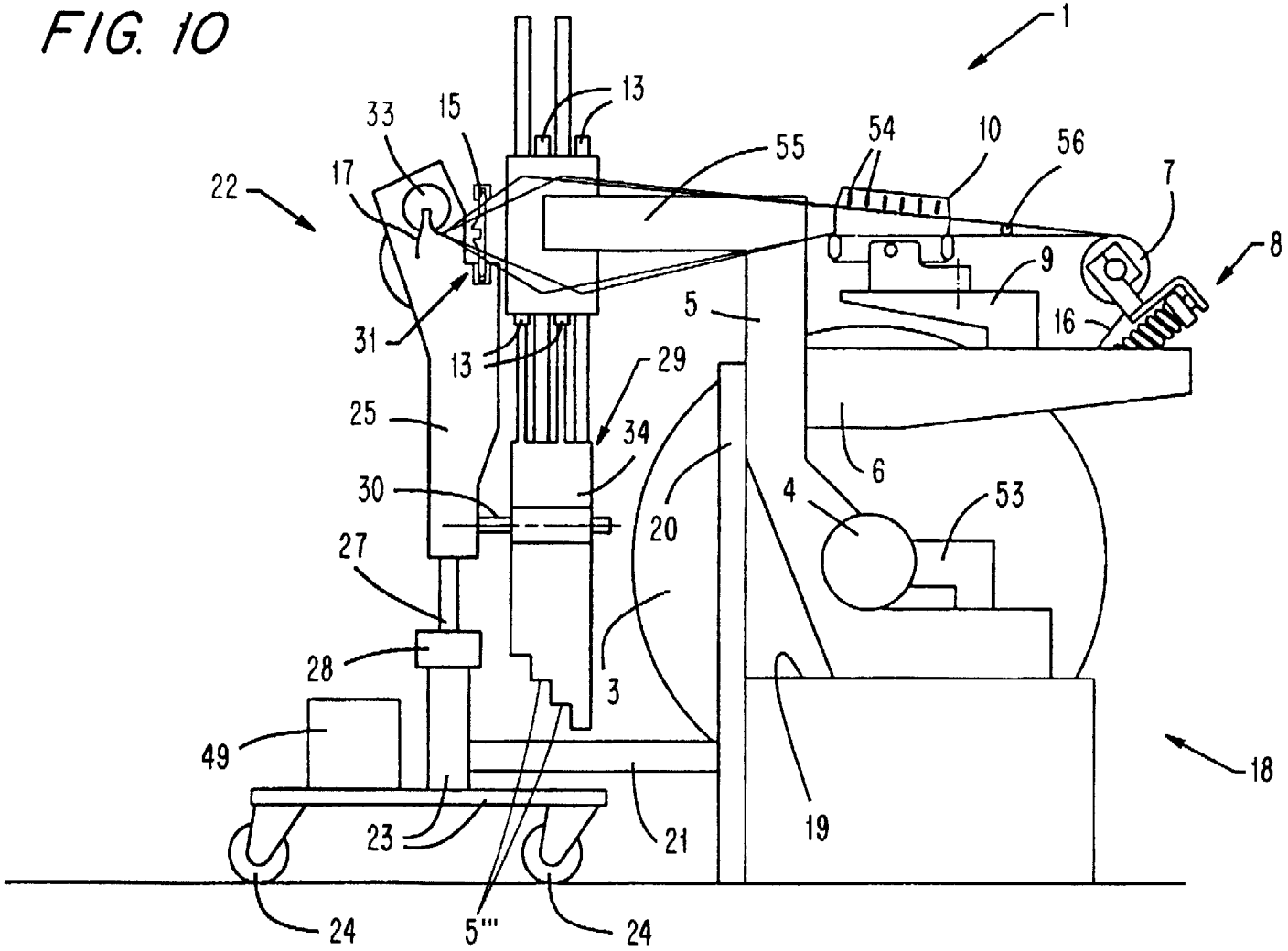
FIG. 10 and 11 show side views in accordance with FIG. 3 while crossbars are inserted.
Figure 11:
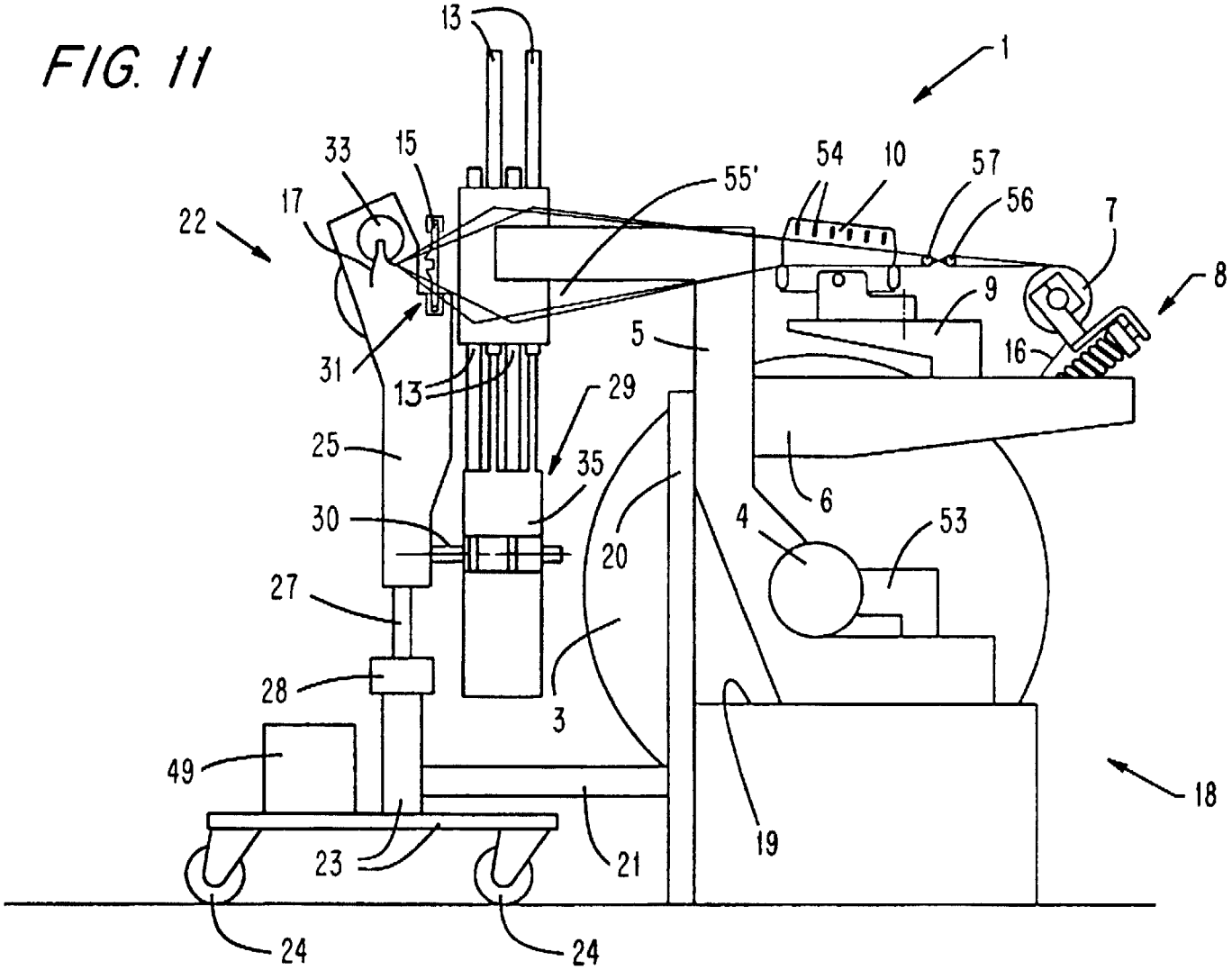
Figure 12:
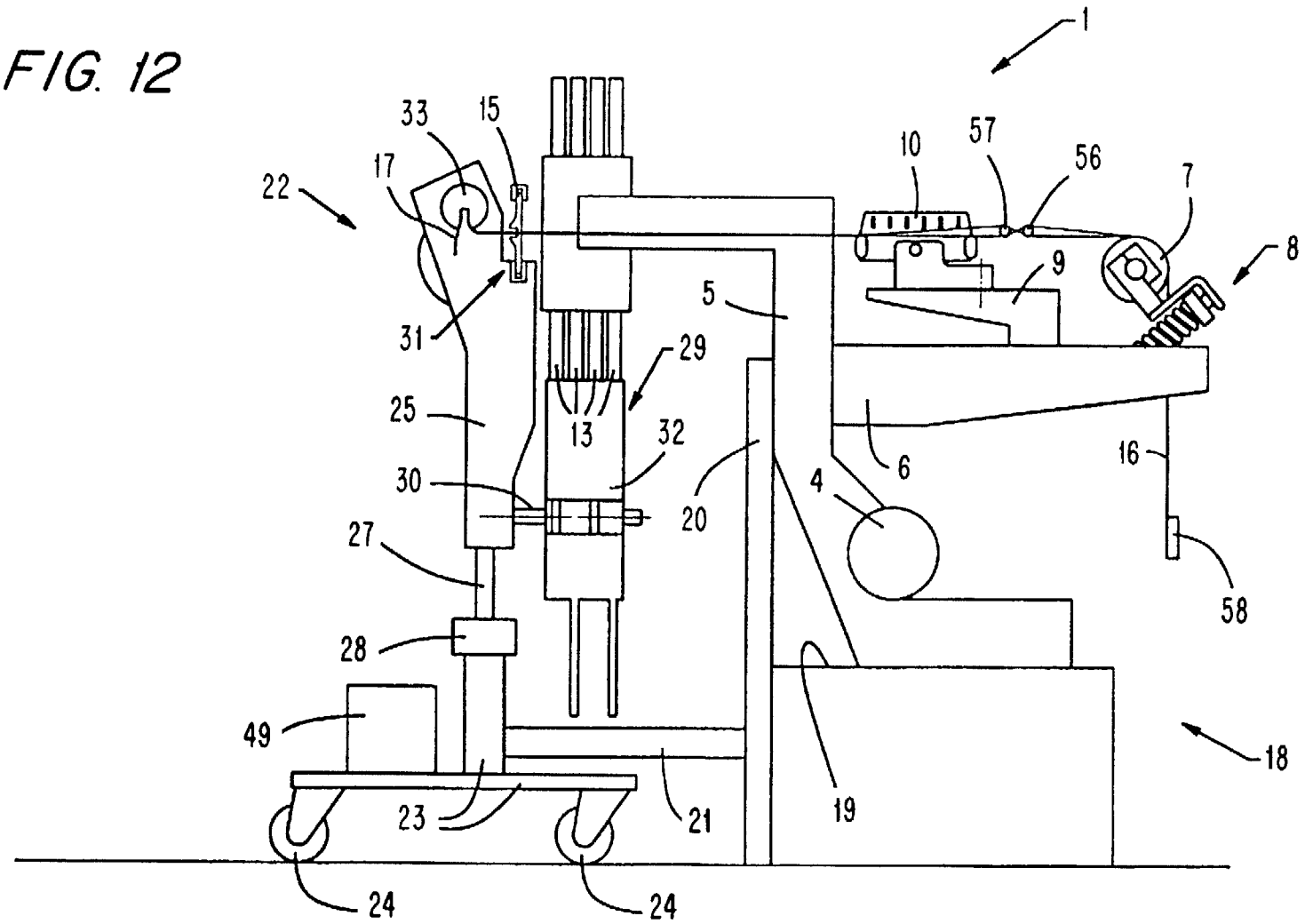
FIG. 12 shows a view in accordance with FIG. 3 after the old warp threads are cut off from the used warp beam which has already been removed.

FIG. 10 shows that the axle (4) of the warp beam (3) has an adjustable brake (53) which prevents the warp beam (3) from rotating. Then the drop wires (54) of the warp stop motion device (10) are released. Then the support elements (29) are rotated so that the arm (34) supports the heald shafts (13). The support surfaces S' of the arm (34) are structured so that the heald shafts (13) have mutually different positions with regard to height (i.e., some heald shafts rise and other descend) and divide the warp threads (16) so that they form a shed (55). Since the drop wires (54) of the warp stop motion device (10) are released the shed (55) also extends into the area between the back rest (7) and the warp stop motion device (10).A crossbar (56) is positioned into this area as is shown in FIG. 10. Then the support elements (29) are rotated so that the support surfaces 5" of the arms (35) support the heald shafts (13) in reverse height position (i.e., the previously raised heald shafts descend, and the previously descended heald shafts rise) so that the shed (55') shown in FIG. 11 is formed. Another crossbar (57) is inserted into this shed (55'). Then a support elements (29) are rotated so that the arms (32) support the heald shafts (13) at the same height level again. The drop wires (54) of the warp stop motion device (10) then are attached again (see FIG. 12). A cramping strip (58) is attached to the warp threads (16) between the back rest (7) and the used up warp beam (3). Then the warp threads (16) are cut off at a location between this cramping strip (58) and the used up warp beam (3). The used up warp beam (3) and the brake (53) then are removed from the loom part (1) so that the state shown in FIG. 12 is attained.

Figure 13:
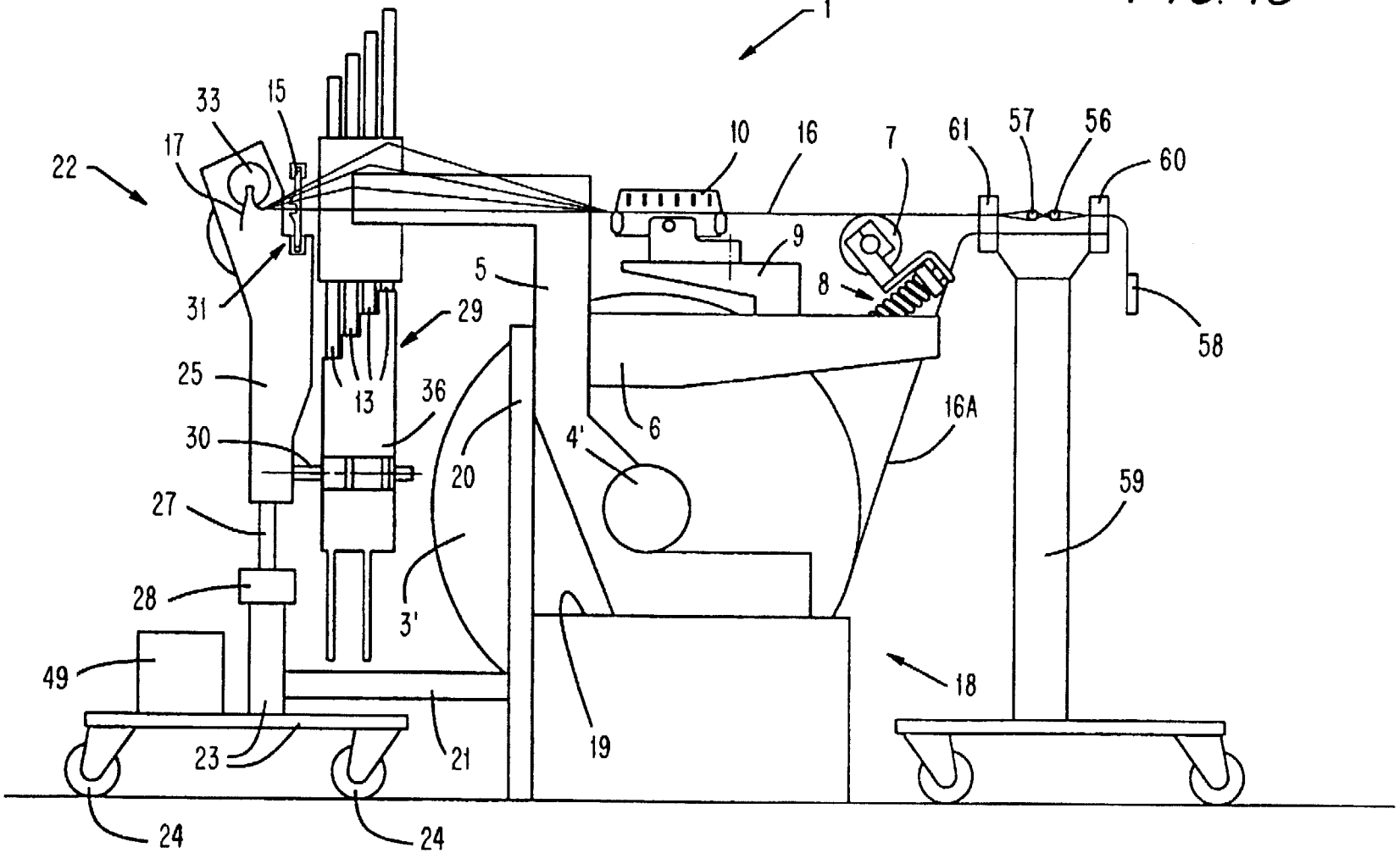
FIG. 13 shows a view in accordance with FIG. 3 after the new warp beam with new warp threads is installed and after a device for attaching the old and the new warp threads is positioned.
Figure 14:
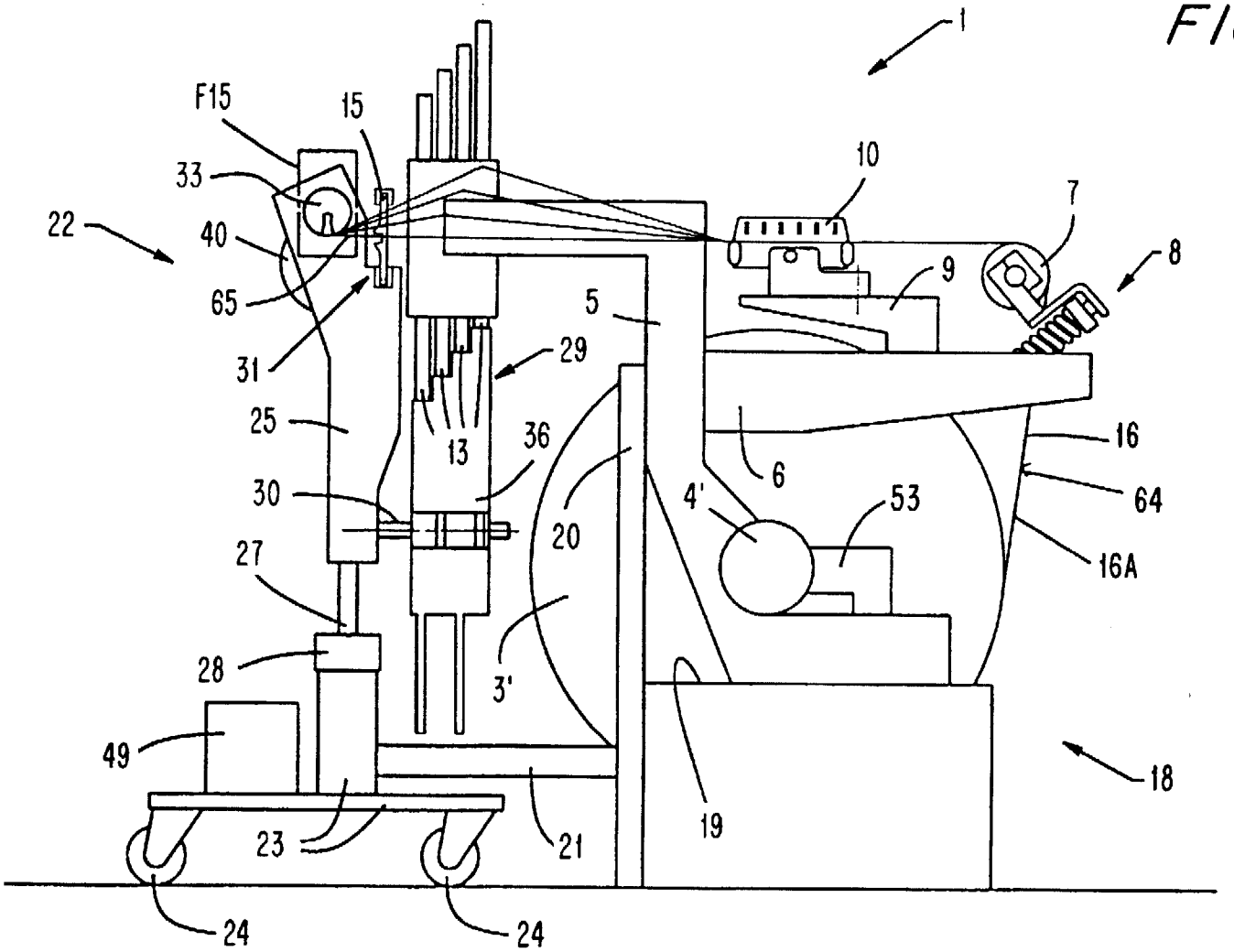
FIG. 14 shows a view in accordance with FIG. 3 after the old and the new warp threads are attached and after the shedding device is prepared for pulling in the warp threads.

Then a new warp beam (3') with its axle (4') is inserted into the loom part (1). The support elements (29) are rotated so that the arm (36) supports the heald shafts (13). The arm (36) has staged stepped support surfaces S'" for the heald shafts (13) which are designed so that the heald shaft (13) closest to the new warp beam (3') is lifted the highest and the heald shaft (13) farthest away from the warp beam (3') is lifted the lowest or not at all. This staged design of the heald shafts makes it easier later on to pull the attachment points, especially knots, through the heddles of the heald shafts (13). In addition a customary attachment device (59) is positioned, especially a knot attachment device. The attachment device (59) has retainers (60, 61) between which the crossbars (56, 57) are shifted and the warp threads (16) are inserted. The warp threads (16) are combed and through which cramped in the area of the retainers (60,61). The warp threads (16A) of the new warp beam (3'), too, are inserted into the retainers (60, 61), combed and cramped as is shown in FIG. 13. Then the old warp threads (16) are attached to the new warp threads (16A) in a customary manner, especially by means of knots (64). After the attachment process is complete the attachment device (59) is removed and the brake (53) is positioned again. The warp threads (16A) are taken up by the warp beam (3') so that the attachment areas (64) are in the vicinity of the new warp beam (3') as is shown in FIG. 14.

Figure 15:
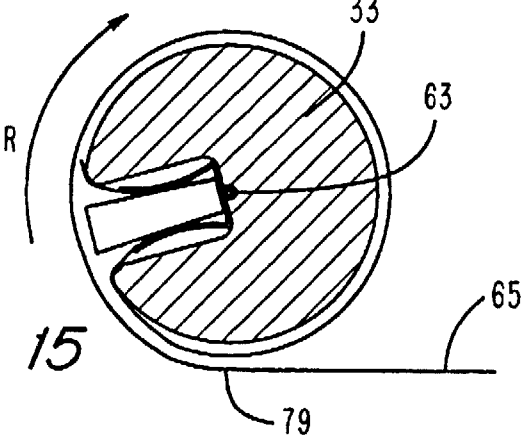
FIG. 15 shows a larger scale drawing of section F15 of FIG. 14.
Figure 16:
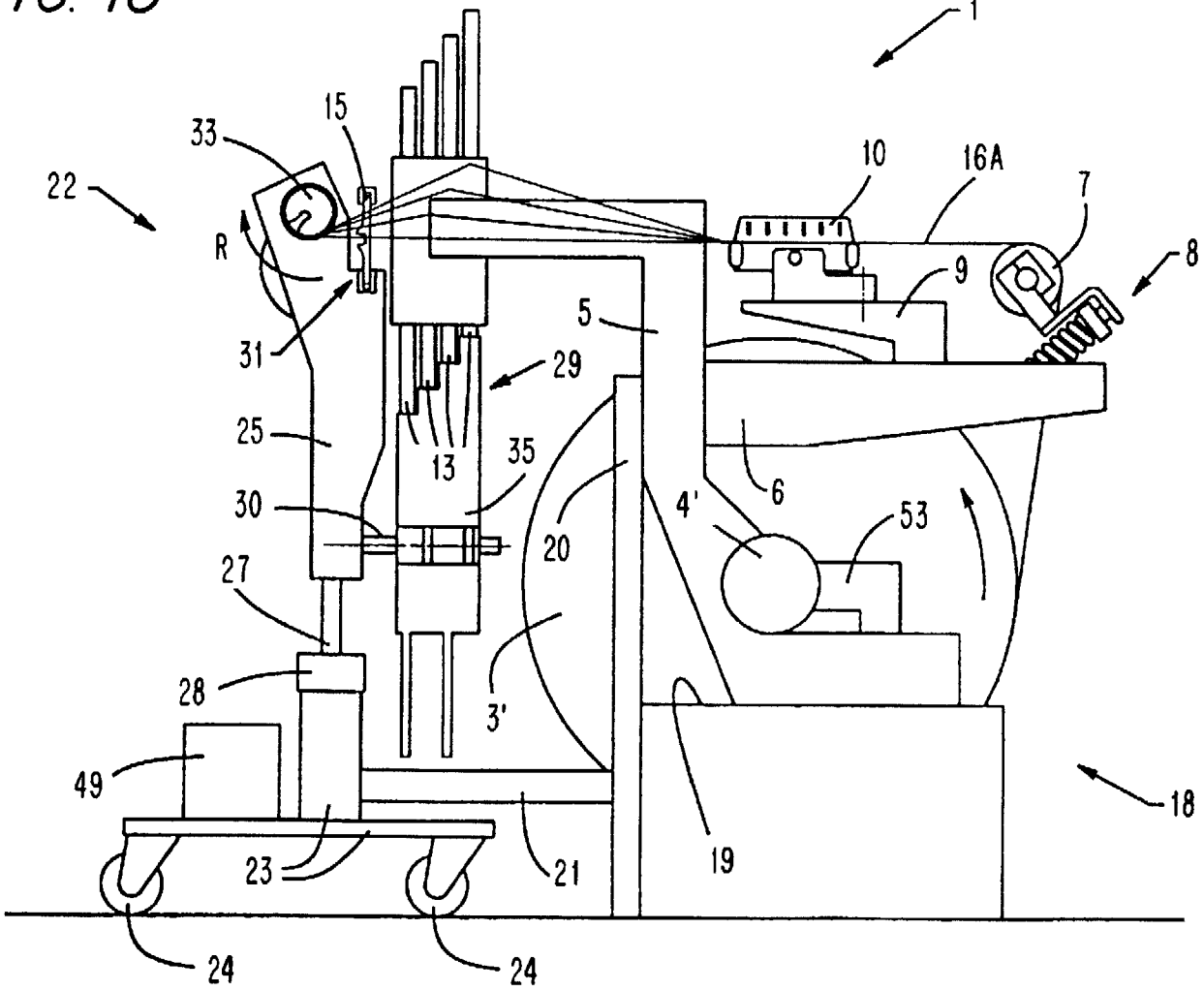
FIG. 16 shows a view in accordance with FIG. 14 while the attached warp threads are pulled through by being taken up on the winding element.

Then the winding element (33) is actuated by means of the actuation motor (40) so that the warp threads (16) are taken up by the winding element (33). The direction of rotation (R) of the winding element is such that it—in the example shown—is clockwise and opposite to the direction of rotation of the new warp beam (3') which is shown in FIG 16. As is shown in FIG. 15 the axis of rotation (63) of the winding element (33) is above point (79) at which the plane (65) of the warp threads is in contact with the circumference of the winding element (33). In the drawings the warp threads (16) are approaching from the right so that the winding element (33) rotates clockwise. The warp threads (16, 16A) are taken up by the winding element (33) and pulled through the warp stop motion device (10), the heald shafts (13) and the weaving reed (15) by this winding element (33) until the attachment areas (64), especially the knots, are located on the winding element (33). Since the warp threads (16, 16A) later on are taken off the winding element (33) again for reasons described below, the taking up process ensures that a sufficient length of the warp threads is taken up so that after the winding element (33) is removed the attachment areas (64) remain on the winding element (33). Since the bearing retainers (43, 45) are almost perpendicular and since the axis of rotation (63) of the winding element (33) is above the plane (65) in which the warp threads (16, 16A) are admitted and since the warp threads are taken up in the direction (R), it is possible to use bearing retainers (43, 45) which are open to the top.

Figure 18:
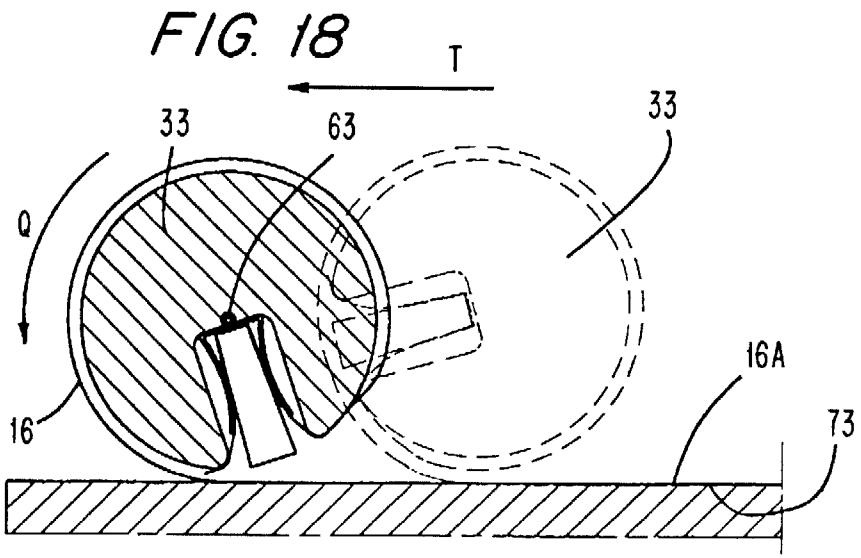
FIG. 18 shows an enlarged drawing of the winding element while it is moved from its winding position into its take-over position.
Figure 17:
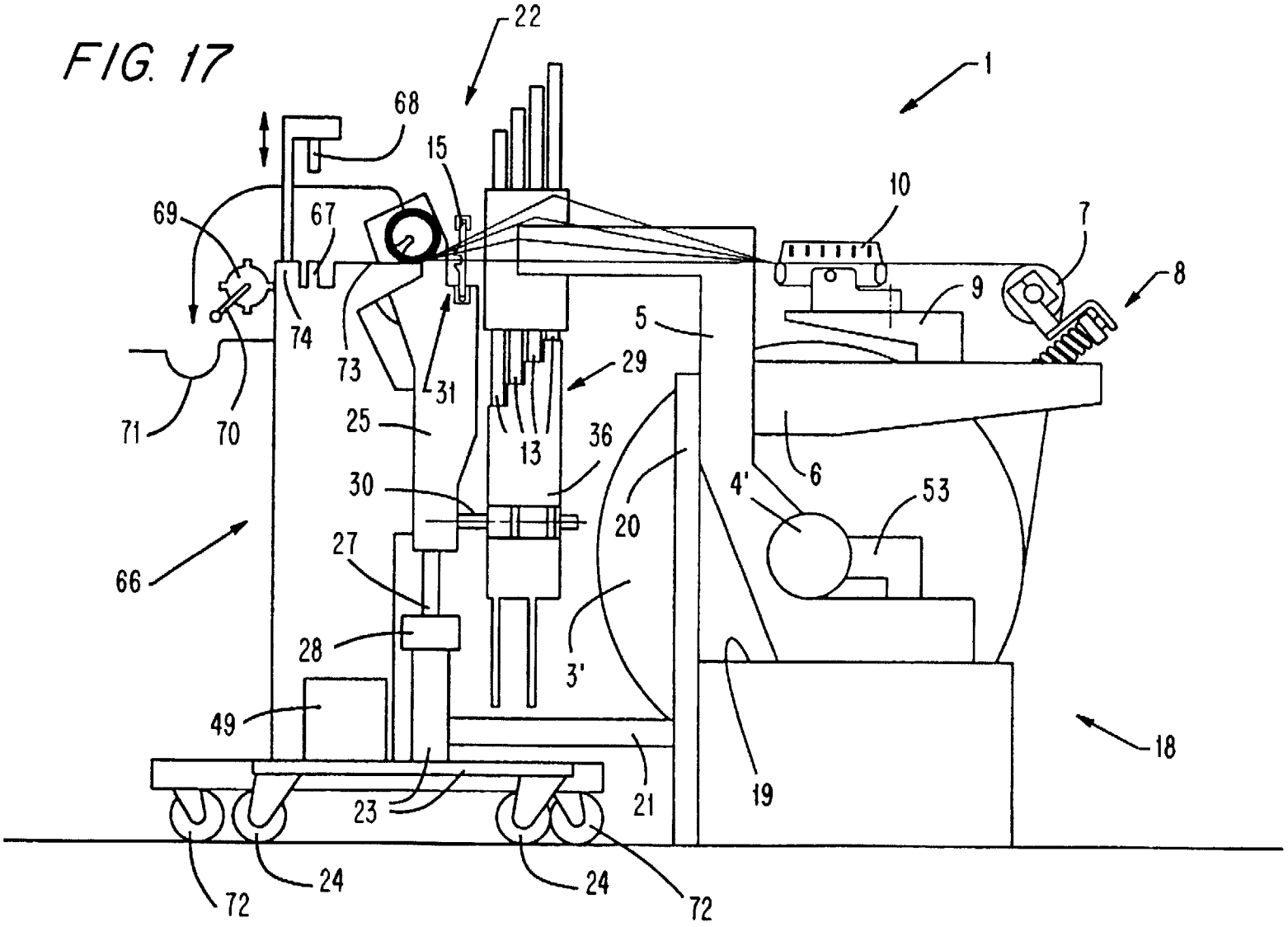
FIG. 17 shows a view in accordance with FIG. 16 after the warp threads are pulled through and after another maintenance device is positioned.
Figure 19:
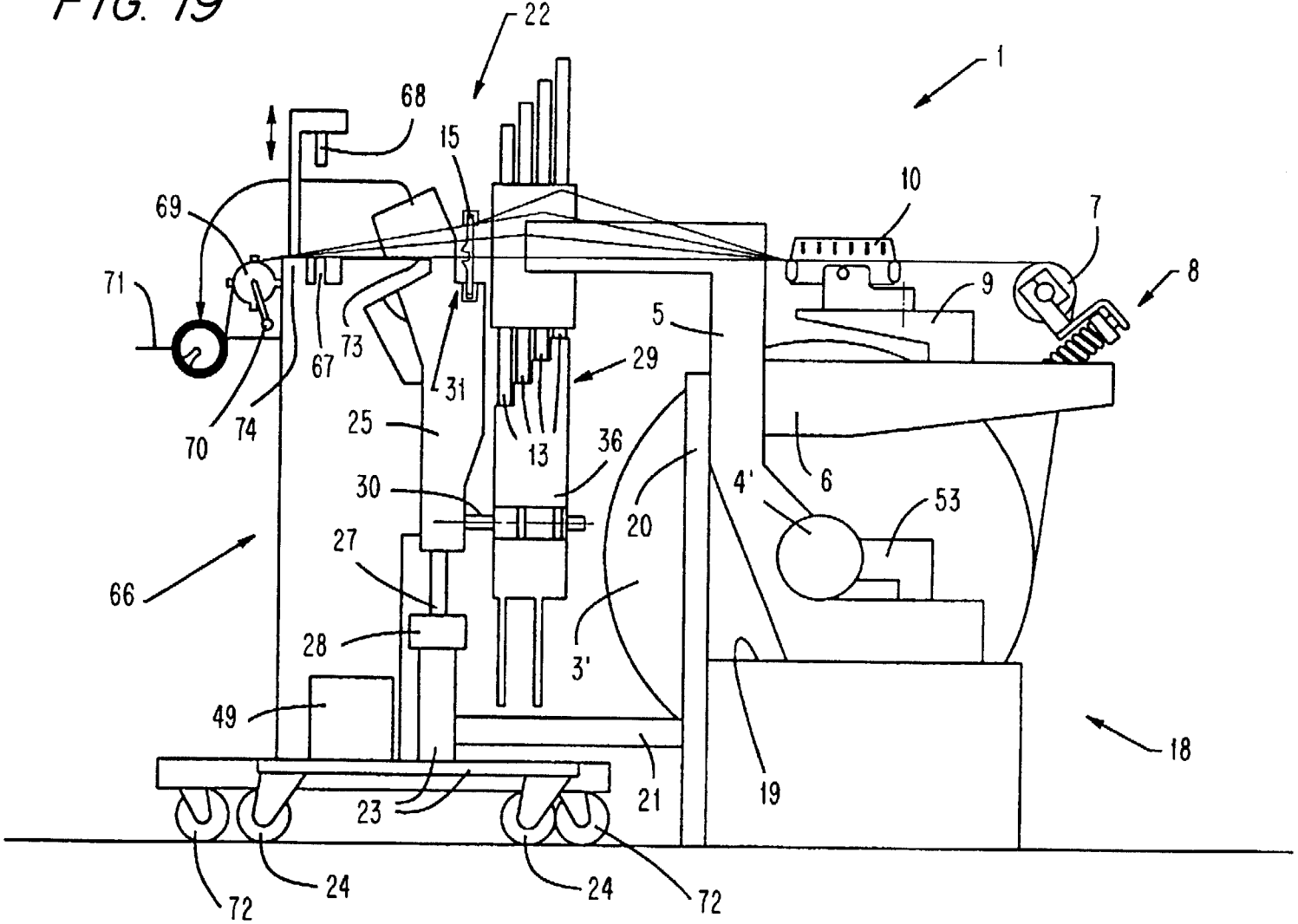
FIG. 19 and 20 show views in accordance with FIG. 17 after the winding element is moved into the take-over position and before and while a foil is bonded.

As is shown in FIG. 17 a maintenance or receiving device (66) which has casters (72) and can be moved and carries a bonding device as described in W093/19233, is positioned. This maintenance device (66) contains two welder terminals (67, 68) of which the welder terminal (68) can be moved vertically with regard to welder terminal (67). This maintenance device (66) also has a rotating brush (69) which can be rotated by means of a lever (70) or a crank. In addition this maintenance device (66) has a retainer or receiver (71) into which the winding element (33) which is removed from the bearing retainers (43, 45) can be placed. The receiver 71 defines a removal position for the winding element 33. The maintenance device (66) has guide surfaces (73, 74) which generally lie at the same height as the lower welder terminal (67) and the brush (69). After the winding element (33) is removed from the bearing retainers (43, 45) it can be placed onto the guide surface (73) and then can be rolled over the guide surface (73), the welder terminal (67), the guide surface (74) and the brush (69) up to a removal positon in the retainer (71) (FIG. 19). The intended direction of the take up ensures that a direction of rotation of the winding element (33) is maintained during this rolling process whose direction of rotation corresponds to the direction of the uncoiling. As is shown in FIG. 18 the rolling process of the winding element (33) in the direction of the arrow (T) on the guide surface (73) ensures that the winding element (33) rotates in the direction of the arrow (Q) and in the process uncoils the warp threads (16A) from the winding element (33). The warp threads (16A) are located between the winding element (33) and the guide surface (73). This ensures that the warp threads do not glide onto one of the guide surfaces which could cause damage. This also makes it possible for one operator to lift the winding element (33) manually from the bearing retainer (43, 45) and then manually move it to the retainer (71) or use the guide surfaces (73, 74) to roll it to the retainer (FIG. 19).

Figure 20:
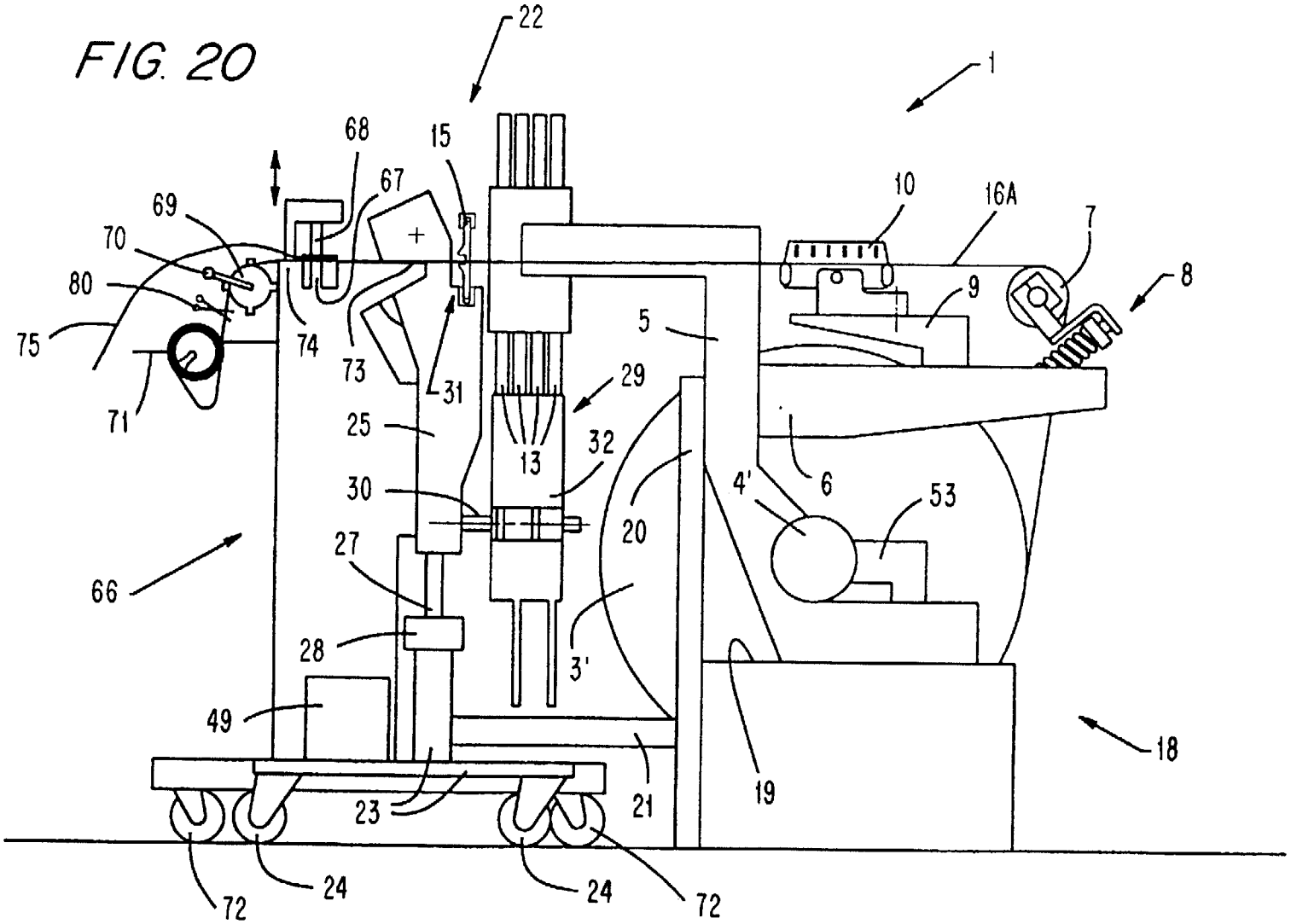
Figure 21:
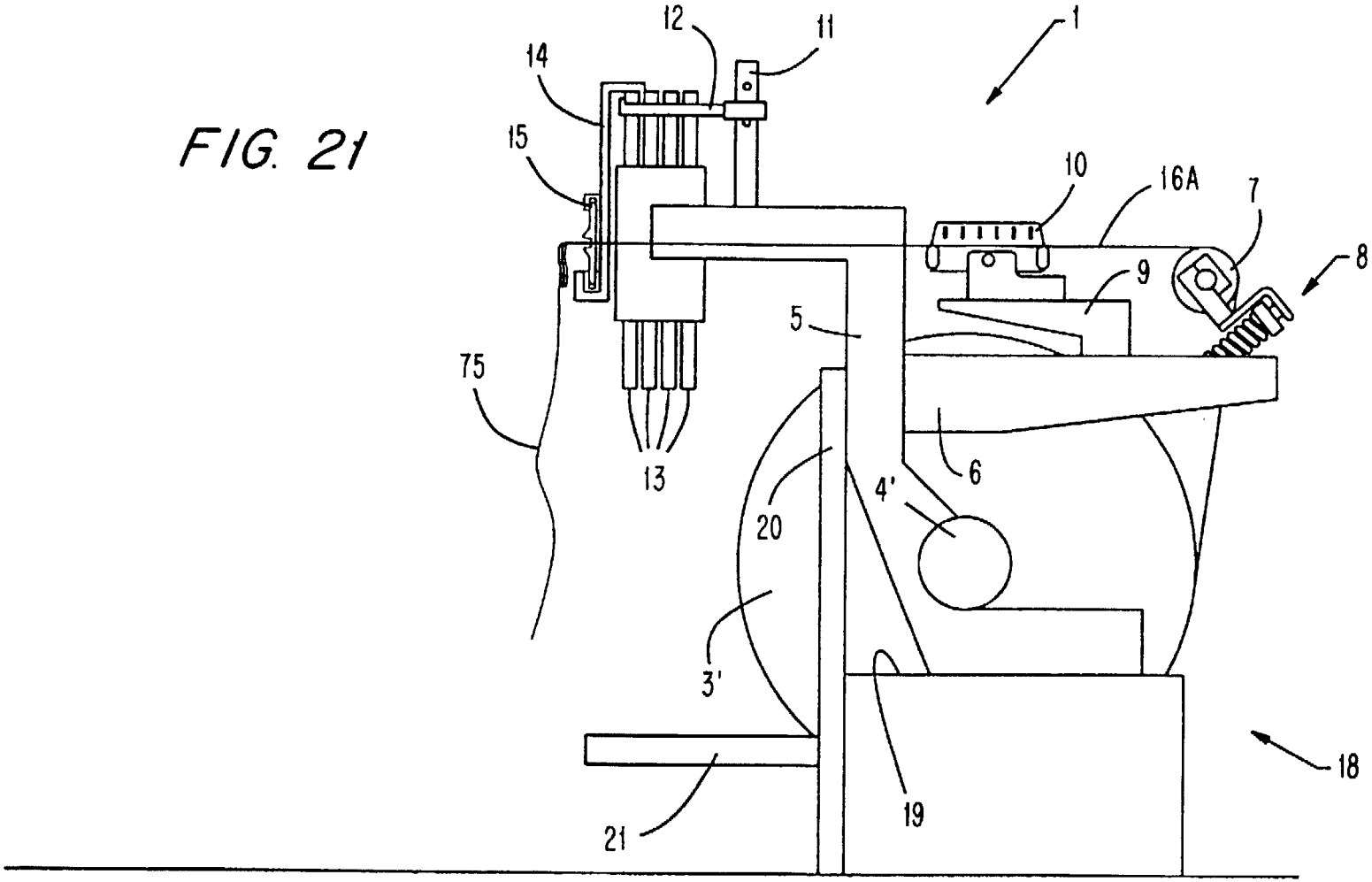
FIG. 21 shows a view of the part of the power weaving loom on the stand after the new warp threads are pulled through and after they are prepared and after the two maintenance devices are removed and FIG. 22 shows a view similar to that in FIG. 16 of a slightly different embodiment in which the guide of the warp threads is changed during the pull-through process.

After the winding element (33) is placed into the retainer (71) the support elements (29) are rotated so that the arms (32) again support the heald shafts (13) which maintain the heald shafts (13) at the same level. Then the brush (69) is rotated which causes the warp threads (16A) to tighten. Then the welder terminal (68) is positioned with regard to welder terminal (67) whereby a plastic foil (75) is inserted with which the warp threads (16A) are bonded (FIG. 20). Then the warp threads are cut manually or by means of a cutting device (80) between the foil (75) and the winding element (33). After this process the maintenance device (66) is removed together with the winding element (33). The supports (11) with the retainers (12) are attached to the frame (5) again and maintain the heald shafts (13). The frame (25) then is lowered to a point where the heald shafts are free. Then the hooks (14) are attached to the outermost heald shaft (13) again. Then the weaving reed (15) is hooked back into the hook (14). Then the maintenance device (22) is removed again. In addition the brake (53) is removed. This results in the state which is shown in FIG. 21. The loom part (1) now is ready and can be taken back to the power weaving loom where it can be inserted again.

Figure 22:
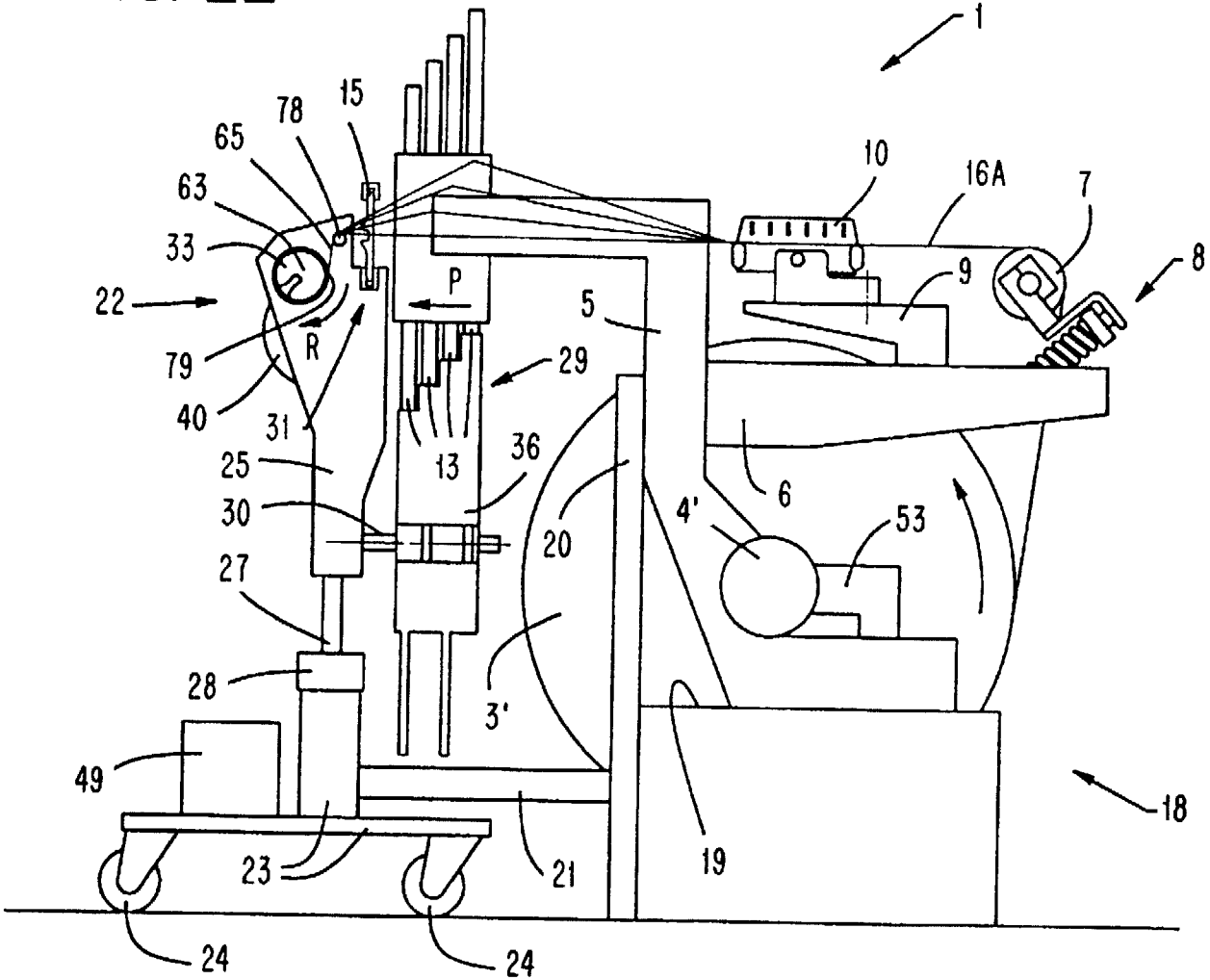

In another embodiment in accordance with FIG. 22, which in principle corresponds to the embodiment described above, there is a deflection roller (78) between the weaving read (15) and the winding element (33). The deflection roller (78) is located approximately in the plane of the warp threads which run from the back rest (7) to the weaving reed (15) while the winding element (33) is located somewhat lower so that the plane (65) in which the warp threads (16A) approach the winding element (33) generally is vertical. Since here, too, the same winding direction (R) is used, the result is a winding process which generally corresponds to the winding process explained in connection with FIG. 15 whereby, however, the plane (65) is turned by 90° C. with regard to the embodiment in accordance with FIG. 15.

The method and the device in accordance with the invention of course can be applied to power weaving looms which do not have any warp stop motion device (10) with drop wires for warp stop motions (54) and/or any heald shafts (13) with heddles and/or any weaving reeds (15) with openings. Above all the invention can also be applied to dobby machines or jacquard attachments.

The method and the device in accordance with the invention can also be used in cases in which the power weaving loom does not have a removable loom part (1) which has a warp beam, a warp stop motion device and/or heald shafts and/or a weaving reed. The method and the device in accordance with the invention can also be applied in cases in which the pulling through of warp threads takes place in the power weaving loom itself. The method and the device in accordance with the invention can also be used in connection with an automatic threading machine whereby this threading machine provides the warp threads.

In a slightly different embodiment only one maintenance device is used. In this case the maintenance device (22) also has a bonding device, i.e. has welding terminals (67, 68), a brush (69) the retainer (71) and the guide surfaces (73, 74).

In another slightly different embodiment there are devices which move the winding device (33) from the winding position to the take-over position in which the welding terminals (67, 68) can be positioned with a foil. Since, for example, the winding element is maintained in the area of its bearing necks (44, 46) guide surfaces (73, 74) are not necessary. In this case, too, the winding element is separated from its actuation device or is at least decoupled so that when the position changes from the winding position to the retaining position it can rotate freely so that the warp threads (16A) can uncoil from the winding element (33) during this movement as well.

We claim:

1. A method of pulling new warp threads through a device of a power weaving loom, comprising the steps of:

A) providing a device of a power weaving loom;

B) attaching old warp threads to new warp threads of a new warp beam;

C) winding the old warp threads onto a winding element such that points of connection between the old and new warp threads are on the winding element, and such that the new warp threads pass through the device; and D) moving the winding element to a removal position with the warp threads remaining thereon.

2. The method according to claim 1, wherein step D comprises rotating the winding element in a thread-unwinding direction.

3. The method according to claim 2, wherein step D further comprises rolling the winding element along a guide to a removal member.

4. The method according to claim 1, wherein step D includes moving the winding element to a bonding device, the method further comprising the step of bonding the new warp threads to a foil at a location spaced from the winding element.

5. The method according to claim 4, wherein subsequent to the bonding step, portions of the new warp threads that have been bonded to the foil are separated from the warp threads disposed on the winding element.

6. The method according to claim 1 further including, prior to step B, the steps of:

separating the old warp threads from a material woven on the power weaving loom, removing a used-up warp beam, together with the old warp threads and the device, from the power weaving loom, separating the old warp threads from the used-up warp beam, replacing the used-up warp beam with the new warp beam.

7. The method according to claim 6, wherein step D includes moving the winding element to a bonding device, the method further comprising the step of bonding the new warp threads to a foil at a location spaced from the winding element.

8. The method according to claim 1, wherein step D comprises moving the winding element onto a removal device and removing the removal device from the area of the new warp threads and new warp beam.

9. The method according to claim 1 wherein step C comprises winding the old warp threads such that the new warp threads pass through the device of a power weaving loom which comprises a warp stop motion device.

10. The method according to claim 1, wherein step C comprises winding the old warp threads such that the new warp threads pass through the device of a power weaving loom which comprises a shedding device.

11. The method according to claim 1, wherein step C comprises winding the old warp threads such that the new warp threads pass through the device of a power weaving loom which comprises a weaving reed device.

12. Apparatus for pulling new warp threads through a device of a power weaving loom, comprising:

supporting means for supporting old warp threads and a new warp beam while new warp threads of the new warp beam are attached to respective old warp threads;

a frame supporting a winding element, the winding element carrying means for making connection with the old warp threads, the frame including a connector for rotatably securing the winding element thereto and permitting the winding element to be removed from the frame;

rotation drive means carried by the frame and including a releasable drive-transmitting coupling with the winding element for rotating the winding element and winding-up the old warp threads and portions of the new warp threads while passing the new warp threads through the device of the power weaving loom; and a receiving device for receiving the winding element with the old and new warp threads thereon, after a release of the releasable drive-transmitting coupling.

13. The apparatus according to claim 12 further including guide means on which the winding element rolls when moved to the receiving device, the rolling being in a direction for producing unwinding of some of the wound-up new warp threads.

14. The apparatus according to claim 12 wherein the frame carries bearings in which the winding element is rotatably mounted when being rotated, the winding element being separable from the bearings in response to being moved to the receiving device.

15. The apparatus according to claim 12 further including a maintenance device carrying the frame on which the winding element is mounted when winding-up the old and new warp threads, the maintenance device being movable toward and away from the supporting means.

16. The apparatus according to claim 15, wherein the device of the power weaving loom comprises a weaving reed, the maintenance device including means for supporting the weaving reed.

17. The apparatus according to claim 16 further including heald shafts mounted on the supporting means for relative vertical movement, and adjusting means mounted on the maintenance device for vertically adjusting the heald shafts.

18. The apparatus according to claim 17, wherein the adjusting means comprises a rotary element having a plurality of radially projecting arms, the arms including adjusting surfaces for engaging the heald shafts, the adjusting surfaces disposed at varying distances from a rotary axis of the rotary element, the rotary element being rotatable about a horizontal axis to bring respective ones of the arms into engagement with the heald shafts.

19. The apparatus according to claim 12, wherein the rotation drive means comprises a motor, and gears interconnecting the motor to the winding element, the gears being uncoupled in response to movement of the winding element onto the receiving device.

20. The apparatus according to claim 12, further including a bonding device arranged to bond a plastic foil to the new warp threads when the winding element is positioned on the receiving device.

21. The apparatus according to claim 12, wherein the winding element is rotatable about a longitudinal axis, the means for making connection with the old warp threads including a radially outwardly open, longitudinal slot formed in the winding element, a cramping element disposed in the slot, and a strip insertable into the cramping element to confine the old warp threads between the strip and cramping element.

* * * * *

UNITED STATES PATENT AND TRADEMARK OFFICE

CERTIFICATE OF CORRECTION

PATENT NO. : 5,775,380
DATED : July 7, 1998
INVENTOR(S) : Kristoff Roelstraete et al.

It is certified that error appears in the above-identified patent and that said Letters Patent is hereby corrected as shown below:

On the title page:

[73] Assignee: please delete "Santrade Ltd., Lucerne, Switzerland" and insert therefor --Picanol N.V., Ieper, Belgium--.

Signed and Sealed this

Fifteenth Day of December, 1998

Bruce Lehman

*Attest:*

BRUCE LEHMAN

*Attesting Officer*

*Commissioner of Patents and Trademarks*

UNITED STATES PATENT AND TRADEMARK OFFICE
CERTIFICATE OF CORRECTION

PATENT NO. : 5,775,380

DATED : July 7, 1998

INVENTOR(S) : Kristoff ROELSTRAETE et al.

It is certified that error appears in the above-identified patent and that said Letters Patent is hereby corrected as shown below:

On the Title Page, item

[73] Assignee: please delete "Santrade Ltd., Lucerne, Switzerland" and insert therefor --Picanol N.V., Ieper, Belgium--

Signed and Sealed this

Thirty-first Day of August, 1999

*Attest:*

Q. TODD DICKINSON

*Attesting Officer*

*Acting Commissioner of Patents and Trademarks*